US010113347B2

(12) United States Patent
Wolfe

(10) Patent No.: US 10,113,347 B2
(45) Date of Patent: Oct. 30, 2018

(54) DOOR GUIDE SYSTEM WITH MODULAR THRESHOLD TRACK

(71) Applicant: ASSA ABLOY ENTRANCE SYSTEMS AB, Landskrona (SE)

(72) Inventor: Jeffrey A. Wolfe, Matthews, NC (US)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 215 days.

(21) Appl. No.: 15/080,677

(22) Filed: Mar. 25, 2016

(65) Prior Publication Data

US 2017/0275936 A1 Sep. 28, 2017

(51) Int. Cl.
*E05D 15/06* (2006.01)
*E05F 5/00* (2017.01)

(52) U.S. Cl.
CPC ..... *E05D 15/0682* (2013.01); *E05D 15/0656* (2013.01); *E05D 15/0686* (2013.01); *E05F 5/003* (2013.01); *E05Y 2201/474* (2013.01); *E05Y 2201/708* (2013.01); *E05Y 2800/404* (2013.01); *E05Y 2800/412* (2013.01); *E05Y 2800/43* (2013.01); *E05Y 2900/132* (2013.01)

(58) Field of Classification Search
CPC ..... E05D 15/0682; E05D 15/0656; E05D 15/0686; E05F 5/003; E05Y 2800/43; E05Y 2800/412; E05Y 2800/404; E05Y 2201/708; E05Y 2201/474
See application file for complete search history.

(56) References Cited

U.S. PATENT DOCUMENTS 1,350,698 A * 8/1920 Boedtcher ..... B66B 13/16 187/331
3,167,112 A * 1/1965 Tucker ..... E05D 15/066 16/105
3,189,313 A * 6/1965 Burns ..... B64D 9/003 16/93 R (Continued)

FOREIGN PATENT DOCUMENTS

CN 203856356 10/2014
CN 203856357 10/2014

(Continued)

OTHER PUBLICATIONS

International Search Report and Written Opinion mailed in corresponding PCT Application PCT/EP2017/056952 dated Aug. 11, 2017.

*Primary Examiner* — Katherine W Mitchell
*Assistant Examiner* — Abe Massad
(74) *Attorney, Agent, or Firm* — Wissing Miller LLP

(57) ABSTRACT

A sliding door and floor guide assembly including a floor guide and at least one door panel including a pin guide assembly, and a guide shoe. The guide shoe has a curved bottom surface and the rail has a corresponding curved upper surface so that the two surfaces can engage one another. The pin guide assembly includes a spring that exerts a downward force to keep the guide shoe and rail in contact with one another. The guide shoe also includes at least one beveled surface adjacent the region where the guide shoe and rail engage. This beveled surface causes debris on the rail to be moved away from the rail when the door is opened or closed so that the debris does not interfere with the operation of the sliding door.

18 Claims, 20 Drawing Sheets

(56) References Cited

U.S. PATENT DOCUMENTS 4,176,497 A * 12/1979 Nagy ..... B61D 19/005 16/93 R
4,646,471 A * 3/1987 Shaiu ..... E05D 15/06 49/229
5,927,017 A * 7/1999 Jacobs ..... E05D 15/0673 16/96 R
6,438,795 B1 * 8/2002 Haab ..... E05D 13/04 16/85
6,826,868 B2 * 12/2004 Finke ..... E05D 15/0604 49/226
8,322,076 B2 * 12/2012 Isaacs ..... E05D 15/066 16/105
9,441,405 B2 * 9/2016 Chubb ..... E05D 15/0686
2009/0003928 A1 * 1/2009 Ohrstrom ..... E06B 3/9647 403/205
2010/0031579 A1 * 2/2010 Choi ..... B66B 13/30 49/503
2010/0115877 A1 * 5/2010 Yoo ..... E05D 15/0686 52/656.2
2016/0060935 A1 * 3/2016 Nilsson ..... E05F 5/003 49/420
2016/0060936 A1 * 3/2016 Nilsson ..... E05F 5/003 49/420

FOREIGN PATENT DOCUMENTS

| | | | |
|---|---|---|---|
| CN | 204163531 | | 2/2015 |
| DE | 29900786 | | 3/1999 |
| EP | 0532347 | | 3/1993 |
| EP | 1245773 | B1 | 10/2002 |
| EP | 2085551 | | 8/2009 |
| EP | 2381056 | | 10/2011 |
| EP | 2381056 | A1 | 10/2011 |
| FR | 2251217 | A5 | 6/1975 |
| JP | 6039018 | B * | 5/1994 |
| JP | 3391639 | B2 * | 3/2003 |
| JP | 2004218418 | A * | 8/2004 |

* cited by examiner

DOOR GUIDE SYSTEM WITH MODULAR THRESHOLD TRACK

FIELD OF THE INVENTION

This invention relates to floor guide systems for automatic sliding doors. More particularly, the invention relates to a floor guide and alignment device for a sliding door that enables the door to swing if it is subject to impact and that resists jamming and excessive wear when the floor guide is exposed to debris, such as in industrial and commercial buildings.

BACKGROUND OF THE INVENTION

Automatic sliding doors are used in commercial and non-commercial settings in order to allow people and things to enter and exit a given area without having to open and close the door manually. Automatic sliding doors are subject to almost constant use, particularly in commercial and industrial buildings. As a result, repair and maintenance of these doors is costly. In commercial settings, for example, DIY (do it yourself) stores, automatic doors and their guide tracks located on the floor at the threshold of the door are subject to significant wear and damage due to high levels of consumer traffic and the movement of machinery such as forklifts, hand trucks, and pallet movers through the door. In addition, these doors are also exposed to large amounts of debris which can interfere with the sliding operation of the door. This debris may range in size from very small particles (e.g., sand, top soil) to larger objects (e.g., gravel, screws, nuts, bolts, etc.). The guide track is also exposed to rainwater, snow, ice, ice melting agents and other debris from outside the building.

In commercial settings, automatic sliding doors must also be able to swing outward in the direction of egress to allow people to safely and quickly exit the building in case of an emergency. This feature also is necessary to comply with fire codes and other regulations. Typically, automatic sliding doors have a guide track set in the floor that allows the door panels to both slide and swing. To allow the door to swing, the lock area of the door disengages and the mechanism that travels along the guide track pivots when the door is subject to emergency egress.

Typically, floor guide systems consist of a pin guide assembly attached to the door that travels within a track along the floor, sometimes called a pin guide track. This pin guide track directs the sliding of the automatic door along a specified path. The pin guide assembly usually has a cross sectional shape that matches the cross sectional shape of the pin guide track. This fit ensures that the door slides along the desired path. A problem with known pin guide assemblies and pin guide track systems is that they are subject to damage when the pin guide assembly and/or the pin guide track area of the door is impacted from misuse of the door. For example, if the door is subject to impact in a manner that forces the pin guide assembly out of the pin guide track, such as impact at the heel of the door, the pin guide assembly, the pin guide track, or both may be damaged.

Another problem with known pin guide assemblies and pin guide tracks is that debris can fall into the slot of the pin guide track, jamming the track, preventing or inhibiting the pin guide assembly from moving along the pin guide track. Debris in the slot may also increase wear of the pin guide assembly and pin guide track, particularly when the debris consists of hard substances like sand.

Another problem with known pin and pin guide systems is that they can be adversely affected by misalignment. Because of variations in height of the floor beneath the pin guide, the elevation of the guide may vary with respect to the door as the pin slides along the guide. An uneven floor surface may also cause the pin guide track to twist, for example, because traffic through the door causes part of the threshold to be pushed down while other parts of the threshold outside the path of traffic flow are not pushed down. Uneven elevation and twisting of the pin guide track may also be caused by cracks that can form in the flooring and by uneven settling of the floor that can occur with newly constructed building. The problem of uneven and twisted pin guide tracks may also result when a door is installed by less experienced personnel. Misalignment of the pin guide track may cause uneven wear of the pin guide assembly and the pin guide track or may damage the pin guide assembly as it travels along the pin guide track or cause door system to rub and damage the finish of the door. Misalignment may also cause the pin guide assembly to jam in the pin guide track preventing movement of the door.

SUMMARY OF THE INVENTION

One aspect of the present invention provides for a guide system that guides the bottom edge of an automatic sliding door along the floor and that can disengage the bottom of the door upon impact without damage to the door or floor guide. It is a further aspect of the invention to provide a guide system that enables the bottom edge of the door to be easily realigned with the guide structure after it has been disengaged. A further aspect of the present invention is to provide a floor guide that is shaped to shed debris to prevent the debris from accumulating in the floor guide.

According to one embodiment of the invention there is provided a sliding door comprising a door panel, a floor guide, a pin guide assembly connected with a bottom of the door panel, and a guide shoe connected with the pin guide assembly. The guide shoe includes a concave mating surface. The floor guide includes a rail having a convex mating surface shaped to correspond with the mating surface of the guide shoe. The mating surfaces of the guide shoe and floor guide are in sliding contact with one another.

According to another embodiment of the invention there is provided a sliding door comprising a door panel, a floor guide, a pin guide assembly connected with a bottom of the door panel, and a guide shoe connected with the pin guide assembly. The guide shoe includes a convex mating surface. The floor guide includes a rail having a concave mating surface shaped to correspond with the mating surface of the guide shoe. The mating surfaces of the guide shoe and floor guide are in sliding contact with one another

BRIEF DESCRIPTION OF THE DRAWINGS

The following description, given by way of example and not intended to limit the invention to the disclosed details, is made in conjunction with the accompanying drawings, in which like references denote like or similar elements and parts, and in which.

DETAILED DESCRIPTION

Embodiments of the invention are described below with reference to the accompanying drawings. It is to be understood, however, that the invention encompasses other embodiments that are readily understood by those of ordinary skill in the field of the invention. Also, the invention is not limited to the depicted embodiments and the details thereof, which are provided for purposes of illustration and not limitation.

Figure 1:
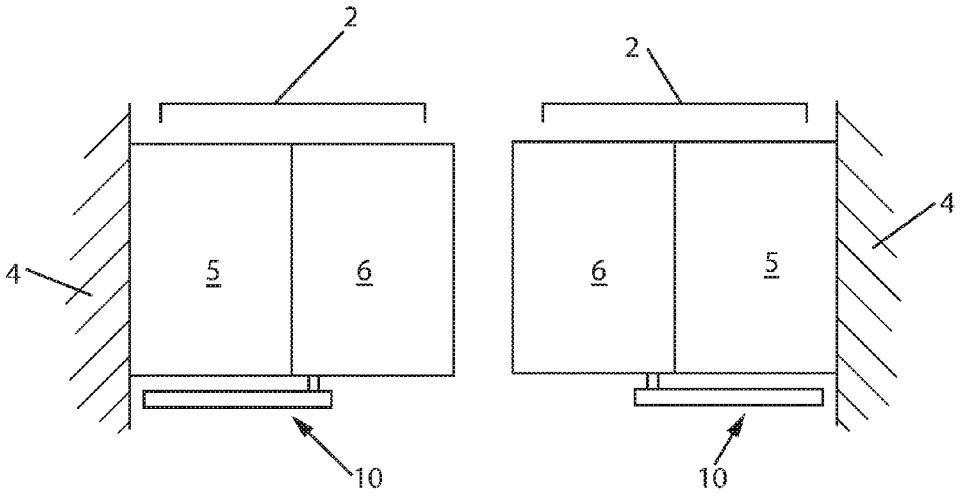
FIG. 1 is a front view of an automatic sliding door mounted in a doorway formed in a wall with an associated floor guide in accordance with an embodiment of the invention.

FIG. 1 shows a sliding door 2 and floor guide assembly 10 in accordance with an embodiment of the present invention. The door may be provided in a wall 4 of a building or other structure such as a commercial or industrial building. In this embodiment, the door 2 is composed of two stationary panels 5 and two sliding door panels 6, sometimes referred to as a bi-parting slider. The sliding panels 6 are supported at the top by a track (not shown) that supports the weight of the panels 6, and allows them to slide to open and close the door 2. The door 2 may also include a drive motor (not shown) coupled with the sliding panels 6 and sensor and control mechanisms (not shown) to open and close the door automatically. At the bottom of the door along the threshold are floor guide assemblies 10 that will be discussed in further detail below. When the door opens, panels 6 slide to the left and right away from each other and are positioned adjacent to respective stationary panels 5. The above embodiment relating to a door with two panels that slide away from each other (i.e., a bi-parting slider) is by way of example and not meant to be limiting. Other configurations of sliding and stationary panels could also be used. For example, doors with a single sliding panel that slides away from a lock jamb to the right or left could be used. Likewise, stationary panels could be omitted and the sliding door panel could be positioned adjacent the wall of the building when the door is in the open position.

Figure 2:
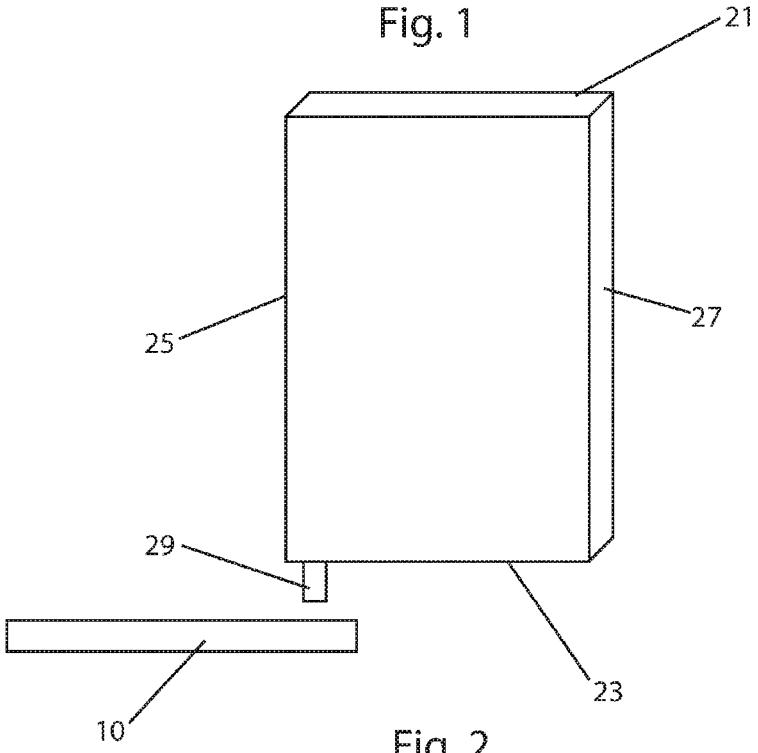
FIG. 2 is a front view of a single panel of an automatic sliding door including pin guide assembly and floor guide track according to an embodiment of the invention.

Each of the sliding panels 6 of the sliding door 2 has a top 21, a bottom 23 and two opposite sides 25 and 27, as shown in FIG. 2. A pin guide assembly 29 is attached near the bottom 23 of the panel 6. A guide shoe 60 of the pin guide assembly 29 interfaces with floor guide assembly 10 as will be discussed with respect to FIGS. 4A-C and 5A-C.

Figure 3:
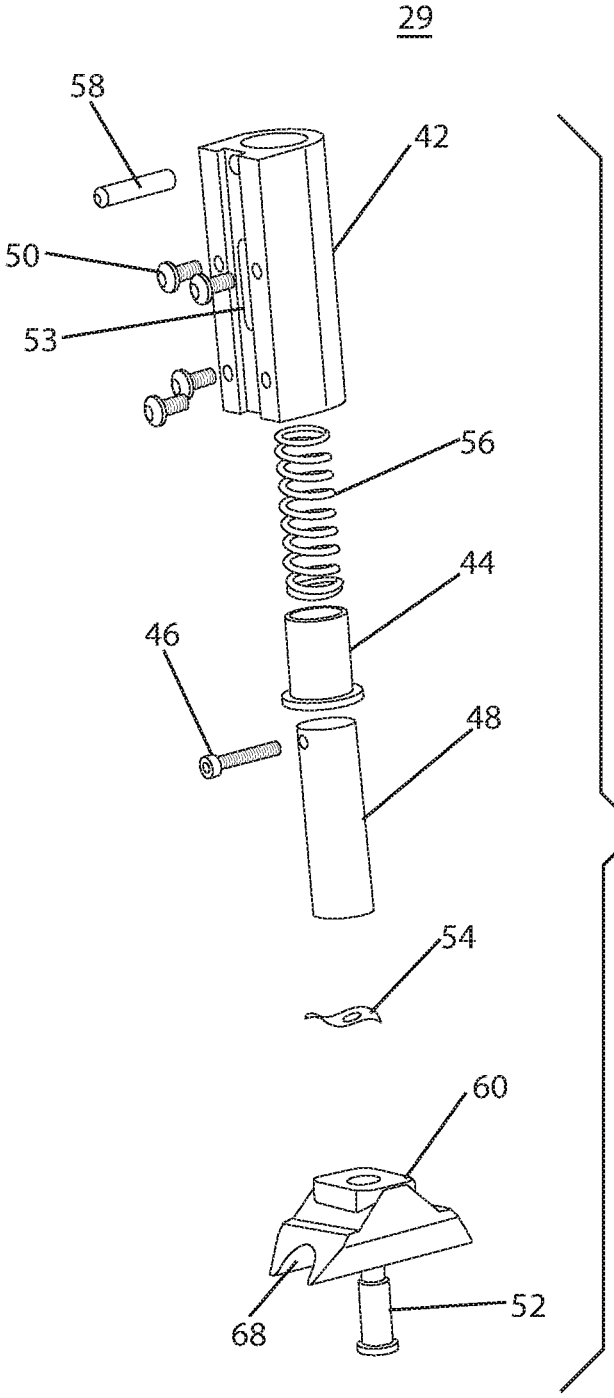
FIG. 3 is an exploded view of a pin guide assembly according to an embodiment of the invention.

FIG. 3 shows an embodiment of the pin guide assembly 29 in an exploded view. Guide assembly body 42 houses components of the pin guide assembly 29, including: flange bearing 44, cap screw 46, guide follower 48, attachment screws 50, shaft screw 52, spring washer 54, wire spring 56, and roll pin 58. Screws 50 attach the pin guide assembly 29 to the inside surface of the door panel. Guide shoe 60 is provided on the lower end of guide follower 48. Shaft screw 52 holds the guide shoe 60 on the guide follower 48. When the pin guide assembly 29 is assembled, the guide follower 48 slides through the flange bearing 44 in and out of the assembly body housing 42 and is pressed downward by wire spring 56. Wire spring 56 provides a force that keeps the guide shoe 60 in contact with the floor guide assembly 10. The cap screw 46 is inserted in the side of the guide follower 42 after it is positioned in the housing 42. The head of cap screw 46 is slidingly engaged in slot 53 of housing 42. Travel of the guide follower 48 up and down within housing 42 is limited by the engagement of the head of the cap screw and the ends of slot 53.

According to one embodiment of the invention, guide shoe 60 has a concave-shaped groove 68 on its lower surface. Guide shoe 60 engages floor guide track 66 of the floor guide assembly 10 within this concave-shaped groove 68 and slides along the floor guide track 66, as will be discussed below.

According to one aspect of the invention, the guide shoe 60 and floor guide track 66 are made from materials that will slide easily against one another and resist wear. Suitable materials include plastics, metals, composite materials and the like. The guide shoe 60 and/or floor guide track 66 may also be formed from any solid or elastomeric material with a lubricating and wear resistant coating applied to one or both of their respective contacting surfaces. According to one embodiment, the guide shoe 60 is formed from polyamide 6.6 with molybdenum di-sulfide (MDS) dry lubricant and the floor guide track 66 is part of an aluminum extrusion with a Teflon® coating. According to other embodiments the guide shoe 60 is formed from resins such as Delrin with 13% PTFE or 20% glass filled PTFE. Such coatings include PTFE (e.g., white, grey, or black Teflon®) or other fluorinated polymers including FEP, PVDF, ETFE, PCTFE, ECTFE, TFE, and PVF.

Figure 4A:
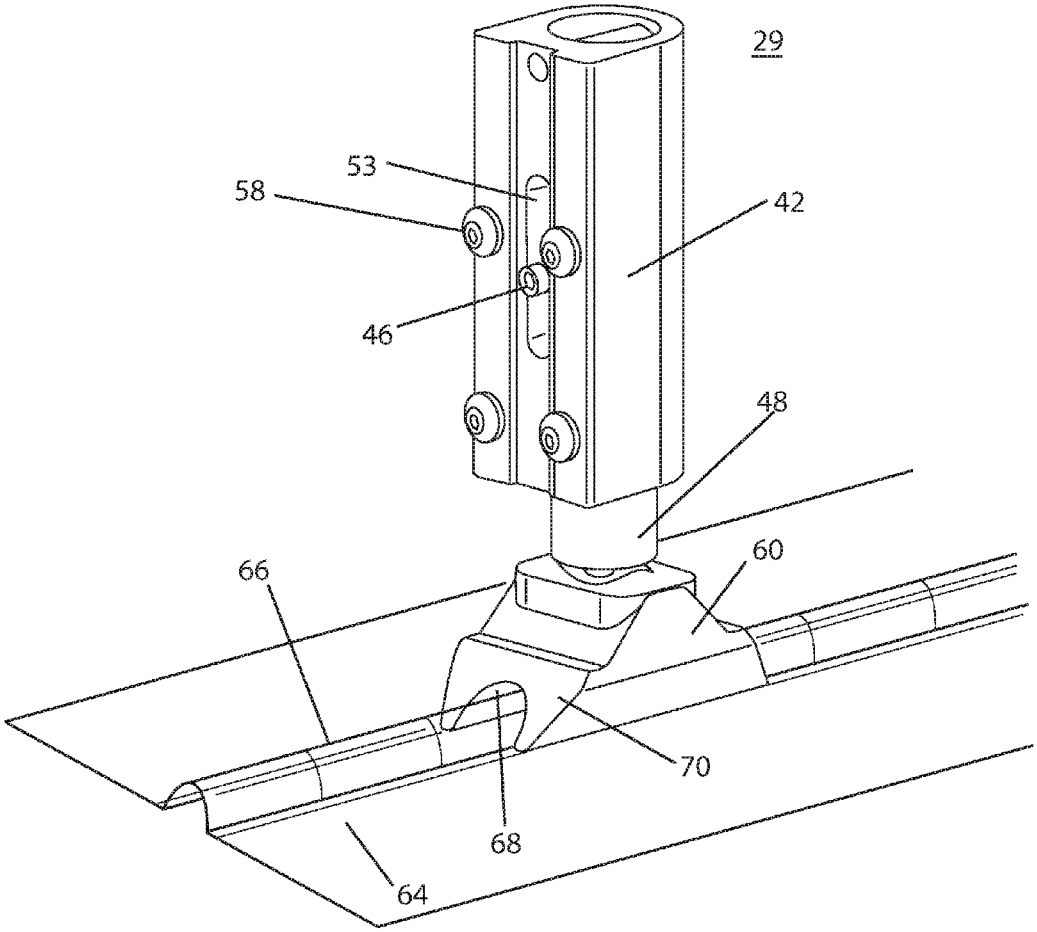
FIG. 4A is a side perspective view of a pin guide assembly mated with a floor guide assembly according to an embodiment of the invention.

FIG. 4A shows the pin guide assembly 29 previously shown in FIG. 3 and its corresponding floor guide assembly 64. Pin guide assembly 29 interfaces with floor guide assembly 64 to guide motion of the door in the desired direction. According to this embodiment, a floor guide track 66 is a part of floor guide assembly 64. Floor guide track 66 and guide shoe 60 are complementary in shape. The concave shape of guide shoe 60 fits over the convex shape of floor guide track 66. The floor guide track 66 and shoe 60 matingly engage to keep the door aligned with the floor guide assembly 64. The wire spring 56 provides downward force against the guide shoe 60 such that the guide shoe 60 is pressed against floor guide track 66. As the guide shoe 60 moves along floor guide track 66, any change in height of the floor guide track 66 relative to the door panel 6 causes the guide follower 48 to move into or out of housing 42. Thus, the guide shoe 60 remains engaged with the floor guide track 66 despite unevenness of the track 66 along its length. According to one embodiment, the concave shaped groove 68 of the guide shoe 60 and convex surface of the floor guide track 66 are partially cylinders, that is, they have a constant radius of curvature. The radius of curvature of these surfaces are preferably between about 0 inches and one inch, more preferably between about 0.25 inches and 0.75 inches, and most preferably about 0.315 inches. Because the guide shoe 60 and floor guide track 66 mate along a curved surface, if the rail twists along its longitudinal axis, the curved surface of the shoe will remain engaged with the floor guide track 66. In addition, because the floor guide track 66 has an arced top surface, debris that falls on the floor guide assembly will tend to fall away from the path of engagement between the guide shoe 60 and floor guide track 66.

The arrangement of the pin guide assembly 29, guide shoe 60, and floor guide track 66 allows the bottom edge of the door 6 to disengage from the floor guide assembly 64 when impact is applied to door 2. Since guide shoe 60 and floor guide track 66 make contact with each other along an arc, when force is applied to the face of the door panel 6, for example, when a person or piece of equipment collides with the heel of the door, the edge at the guide shoe 60 will be forced sideways against the floor guide track 66. This will cause the edge of the shoe 60 to ride up the floor guide track's curved surface, compressing the spring 56. If sufficient force is applied to the door panel 6, the guide shoe 60 will be forced over the crown of the floor guide track 66, thus disengaging the bottom 23 of the door 2 from the floor guide. This allows the door to tilt away from the force of the collision. By adjusting the spring 56, the amount of force required to disengage the bottom 23 of the door panel 6 from the floor guide can be adjusted. According to one embodiment the force required to disengage the guide shoe 60 from the floor guide track 66 is low enough that an impact will cause disengagement without damage to the door. According to one aspect of the invention, the spring forces the guide shoe against the floor guide track with preferably between about 2 and 10 pounds of force, more preferably between about 4 and 8 pounds of force, and most preferably between 5 and 7 pounds of force. According to a preferred embodiment, when the force of an impact is at least about 200 pounds the guide shoe will disengage from the floor guide track.

Following disengagement of the shoe 60 from the track 66, the door panel 6 can be reconnected to the floor guide by pulling the door back toward the track 66 such that the edge of the guide shoe rides up the curved surface of track 66, again compressing spring 56, until the guide shoe passes over the crown of the track 66 and the downward force of spring 56 snaps the guide shoe 60 into engagement with rail 66.

Figure 4B:
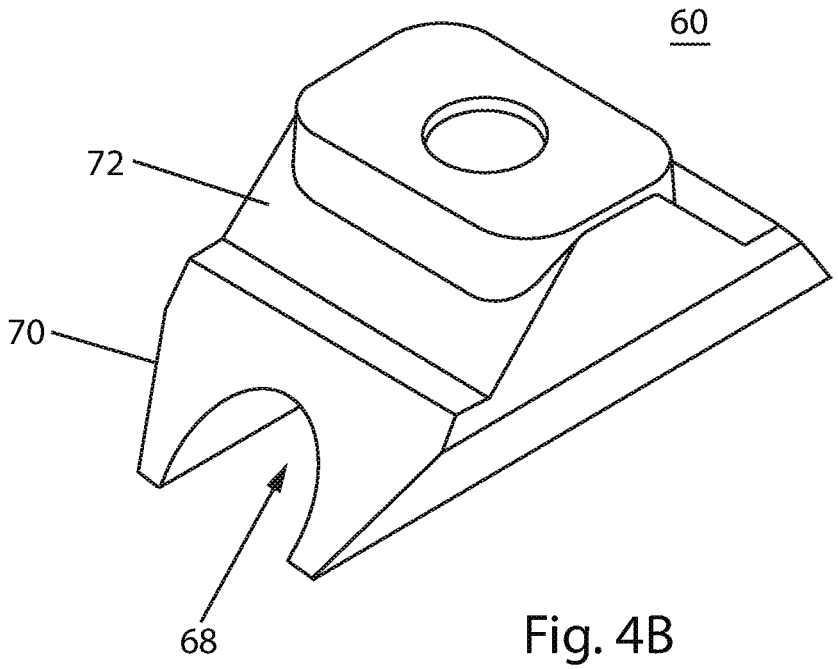
FIG. 4B is a perspective view of the guide shoe portion of the pin guide assembly according to the embodiment of FIG. 4A.
Figure 4C:
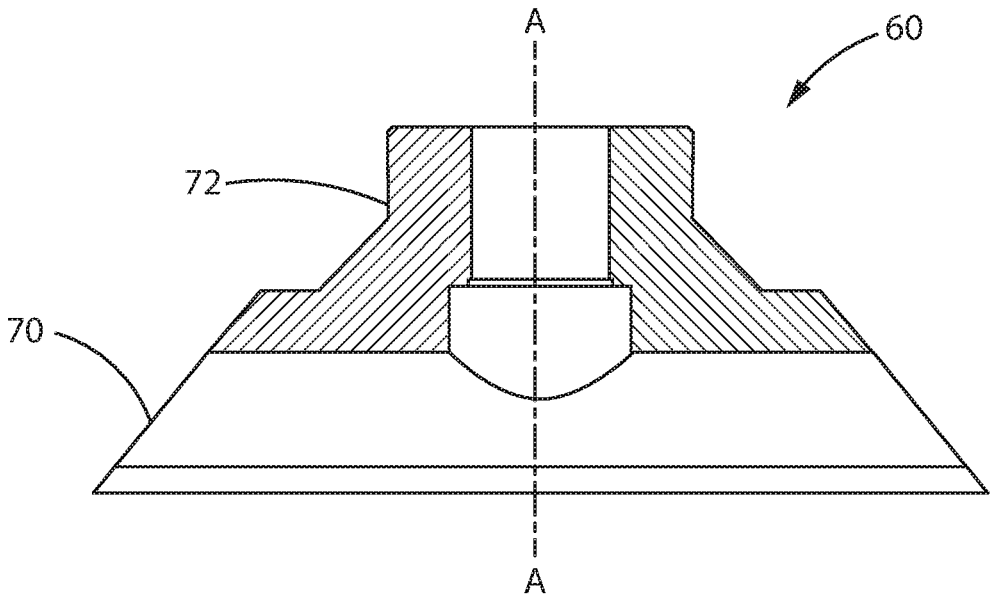
FIG. 4C is a vertical cross section of a guide shoe according to the embodiment of FIG. 4A.

FIG. 4B shows a orthogonal view of a guide shoe 60 previously described with respect to FIGS. 3 and 4A. FIG. 4C illustrates a vertical cross section through guide shoe 60. As shown in FIG. 4C, guide shoe 60 has a beveled surface 70. As the shoe 60 moves along the track 66, this beveled surface 70 lifts debris from the surface of the track 66, thus clearing the track 66 of debris. The beveled surface 70 also removes material that may adhere to the track 66, such as ice that might freeze to the track 66 in cold weather during use. According to one aspect of the invention, this bevel is preferably at an angle between about 20 degrees and about a 80 degrees with respect to the surface of the track, more preferably at an angle between about 40 and 60 degrees with respect to the surface of the track, and most preferably at an angle of about 50 degrees with respect to the surface of the track. According to one embodiment, the opposite face of guide shoe 60 is also beveled so that debris is removed from the rail as the door panel moves in both directions on floor guide assembly 64.

Figure 4D:
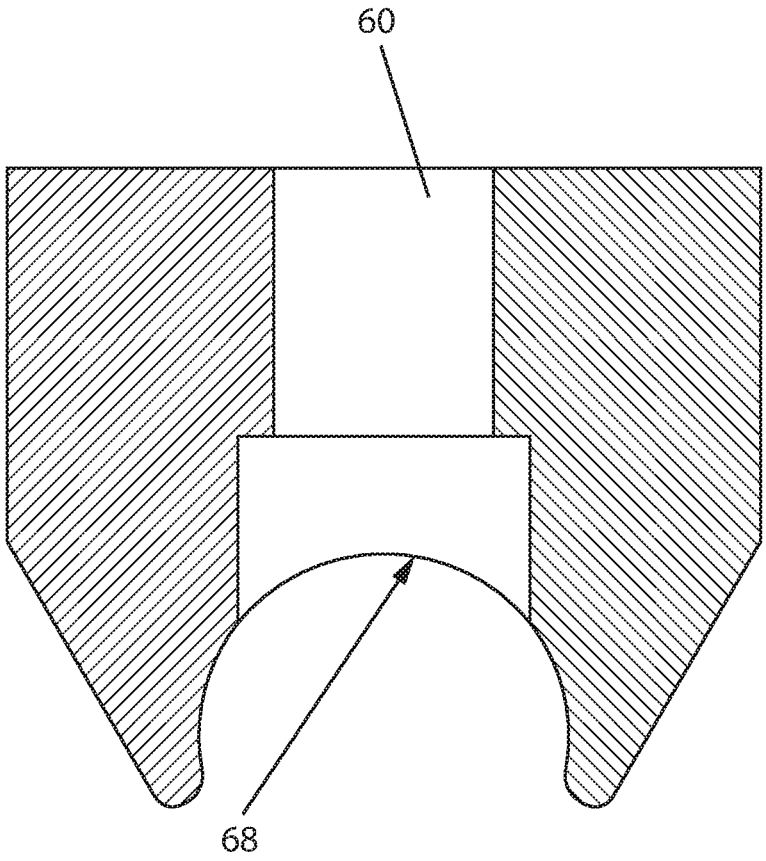
FIG. 4D is a cross section of the guide shoe along line A-A in FIG. 4C.

FIG. 4D shows a cross section of the guide shoe 60 along line A-A in FIG. 4C. The concave groove according to this embodiment has a constant radius (r) so that its surface conforms to the surface of a partial cylinder. Other shaped grooves are also within the scope of the invention.

Figure 5A:
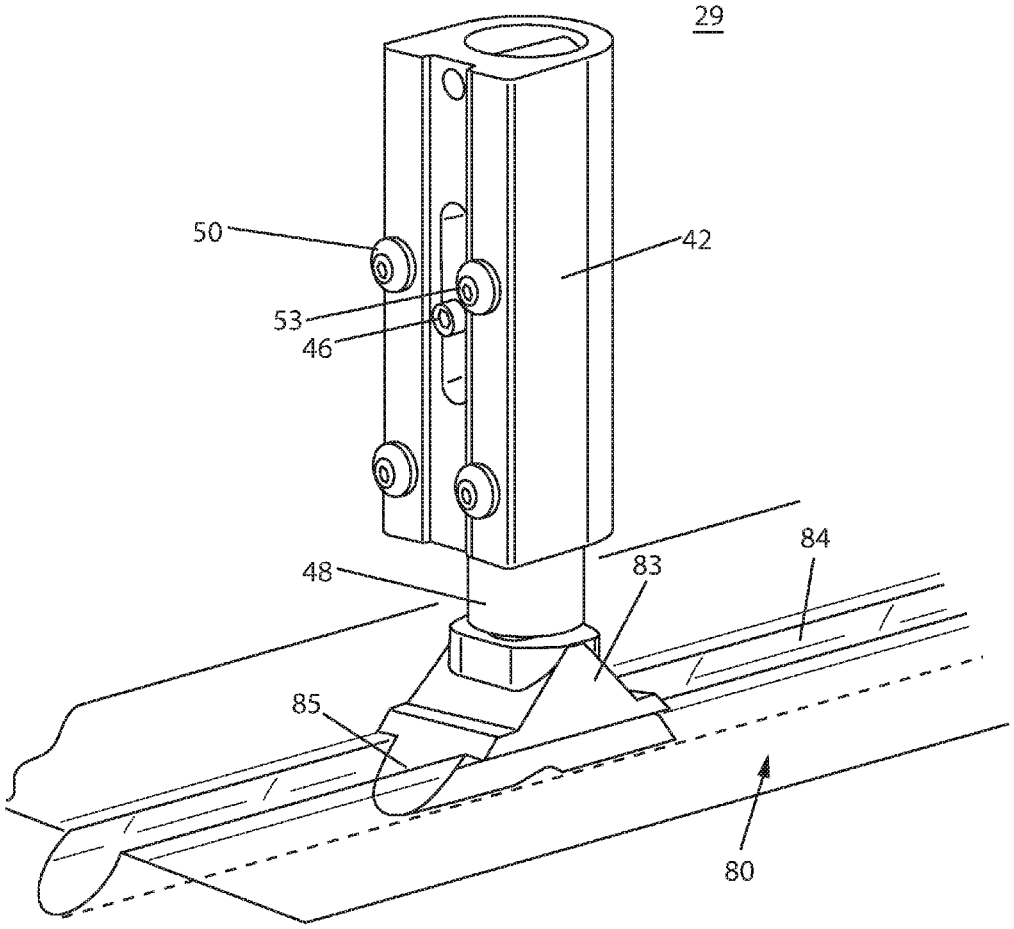
FIG. 5A is a side perspective view of a pin guide assembly mated with a floor guide assembly accord to an alternative embodiment of the invention.
Figure 5B:
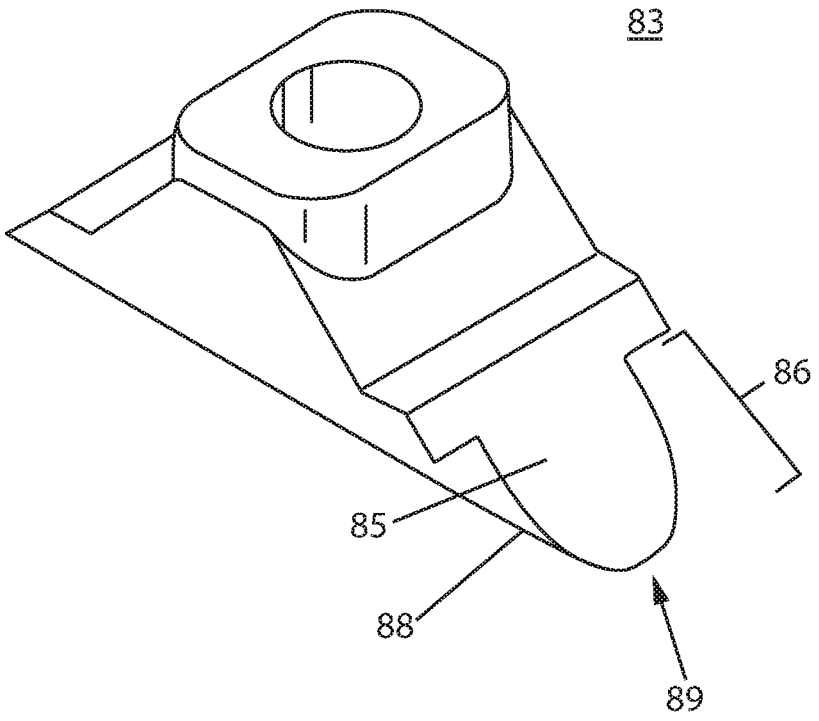
FIG. 5B is an perspective view of the guide shoe portion of the pin guide assembly according to the embodiment of FIG. 5A.
Figure 5C:
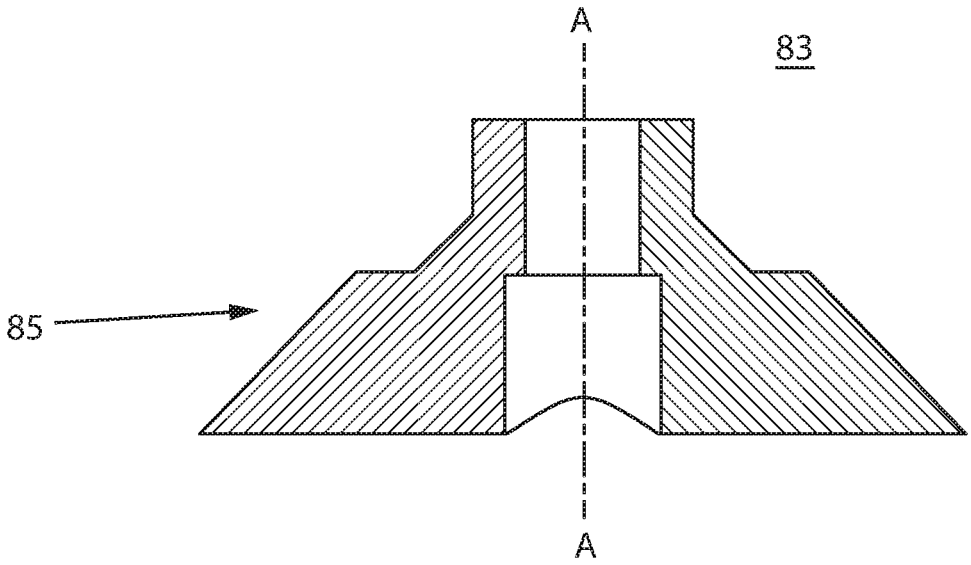
FIG. 5C is a vertical cross section of the guide shoe according to the embodiment of FIG. 5A.
Figure 5D:
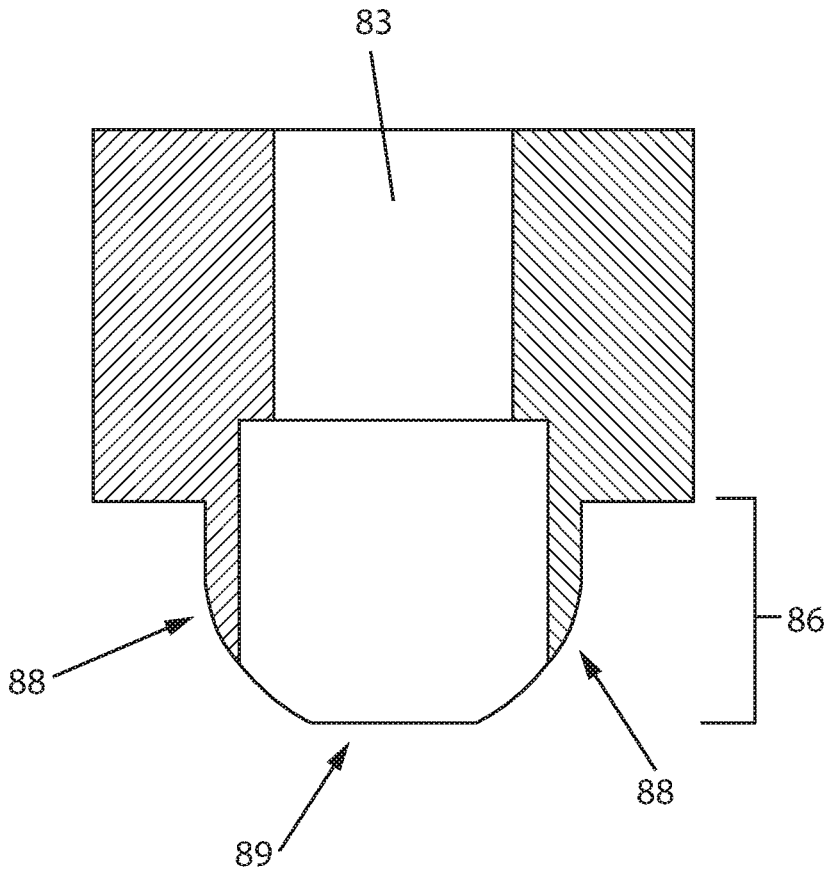
FIG. 5D is a cross section of the guide shoe along line A-A in FIG. 5C.

FIG. 5A shows an alternate embodiment of the invention including a concave floor guide assembly 80 and pin guide assembly 29 with a convex guide shoe 83. The pin guide assembly 29 may be the same as the one shown in FIG. 3 except for a different guide shoe as discussed below. In this embodiment, the convex surface of guide shoe 83 fits into the concave groove of floor guide track 84. Motion of the door in the desired direction occurs in the same manner as described in the embodiment described with respect to FIGS. 4A-D. FIG. 5B shows an orthogonal view of a guide shoe 83 described in FIG. 5A. FIG. 5C shows a vertical cross section through guide shoe 83 as previously shown in FIG. 5A-B. FIG. 5D shows a cross section of guide shoe 83 along line A-A in FIG. 5C.

According to one embodiment, the convex surface 86 of guide shoe 83 has a constant radius and is in the form of a partial cylinder. The radius of curvature of this surface is preferably between about 0 inches and one inch, more preferably between about 0.25 inches and 0.75 inches, and most preferably about 0.315 inches. According to another embodiment, the convex surface 86 consists of two arcs 88 connected by a flat portion 89 at the bottom most part of the guide shoe 86. The inside surface of the floor guide track 84 has a shape that conforms with the surface of the guide shoe 83.

Guide shoe 83 has front and rear faces that include a beveled surface 85. Like the embodiment discussed in relation to FIGS. 4A-D, as the guide shoe 83 travels within the floor guide assembly 80 any debris inside the guide track will be lifted upwards and away from the guide 80 by beveled surface 85. Guide shoe 83 is connected with guide follower 48 by shaft screw 52 of the pin guide assembly 29.

In the embodiments discussed above, the floor guide and sliding door are capable of being installed on a floor that is uneven or cracked. As previously discussed with respect to FIG. 3, pin guide assembly 29 includes wire spring 56. The wire spring 56 provides a downward force to ensure that guide shoe 60, 83 remains engaged with the floor guide assembly 64, 80. Wire spring 56, in combination with the other elements that make up pin guide assembly, allow the guide shoe 60, 83 to move vertically as it slides across a floor guide. Thus, the pin guide assembly 29 allows the guide shoe 60, 83 to adjust vertically to accommodate a range of uneven heights of the floor guide assembly 64, 80. This range may be between about 0 and 1 inch, more preferably between about 0.25 and 0.75 inches, and most preferably about ⅜$^{th}$ of an inch. The guide shoe 60, 83 is pushed upwards where the floor guide assembly 64, 80 is higher and moves downward because of the force of the spring 56 where the floor guide assembly 64, 80 is lower. The system is installed such that wire spring 56, in an initial state, is partially compressed to provide the above-mentioned force to ensure there is adequate mating between the alignment block and the floor guide assembly.

The curved interface between the guide shoe 60, 83 and floor guide track 66, 84 accommodates twisting of the floor guide assembly 64, 80 that may result from settling of the underlying floor or from improper installation. Because of the curvature of the interface, the shoe will remain engaged with the floor guide assembly if the guide assembly is twisted about its longitudinal axis with respect to the guide shoe. The curved shape of the guide shoe 60, 83 is capable of rolling side to side while remaining in contact with the corresponding surface of the floor guide track 66, 84 without dislodging or being damaged.

Figure 6:
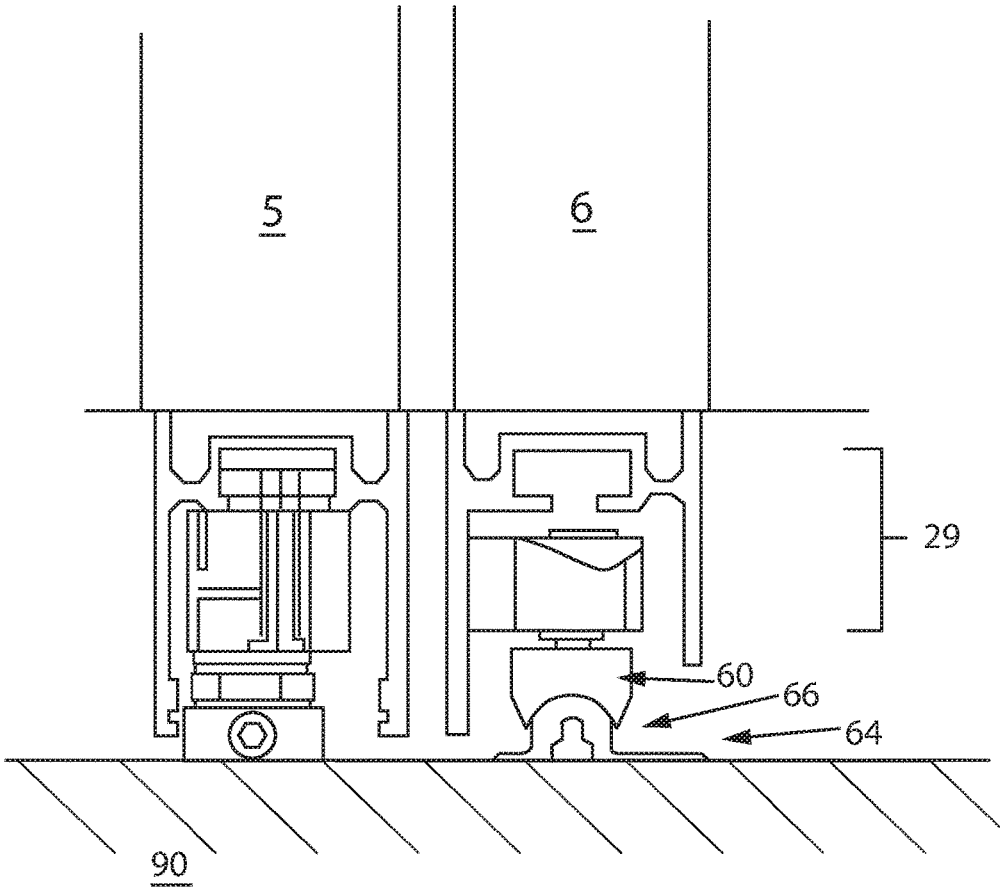
FIG. 6 is an end view showing a vertical cross section of a sliding door and floor guide assembly according to the embodiment of FIG. 4A.
Figure 7:
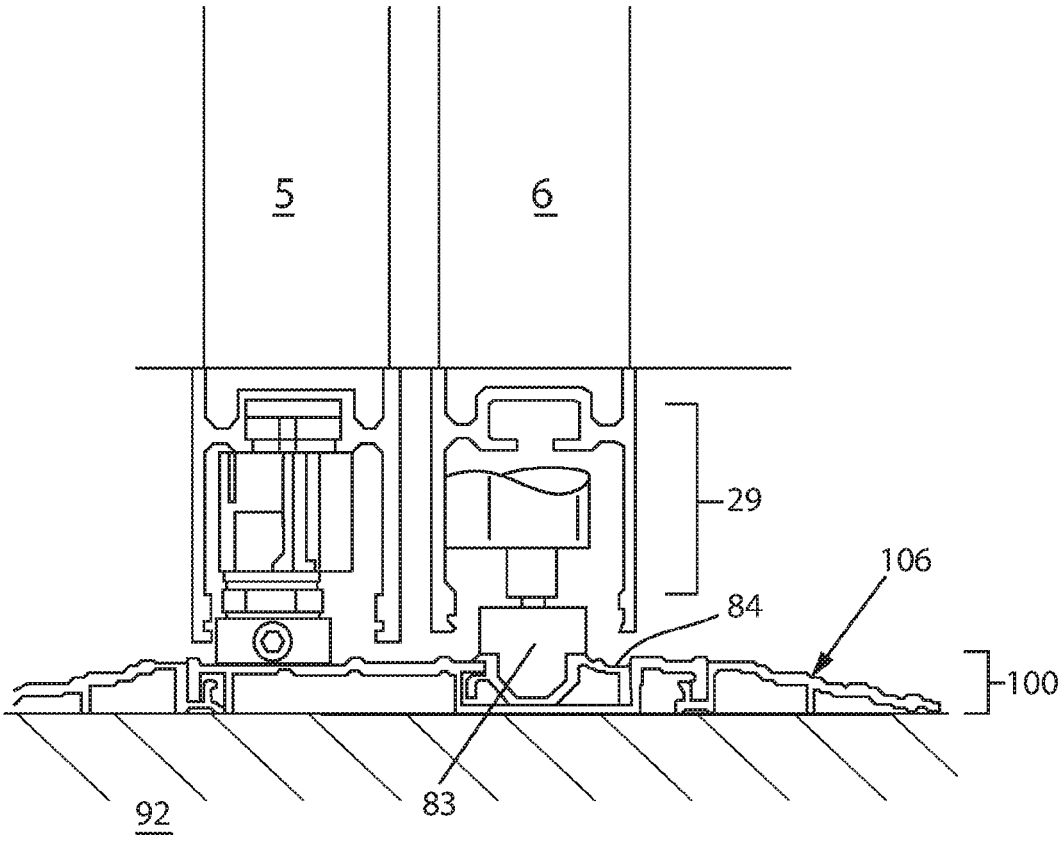
FIG. 7 is an end view showing a vertical cross section of a sliding door and floor guide assembly according to the embodiment of FIG. 5A.
Figure 8:
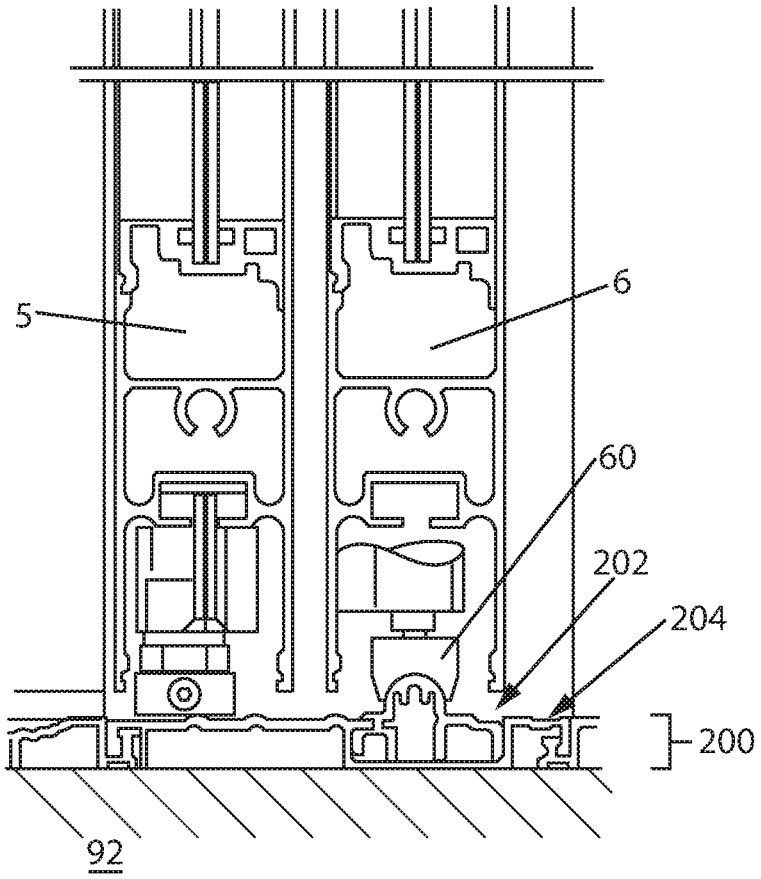
FIG. 8 is an end view showing a vertical cross section of the sliding door and floor guide assembly according to a further embodiment of the invention.

FIGS. 6 through 8 show cross sections of automatic sliding doors with associated floor guides according to additional embodiments of the invention. In each of these embodiments panel 5 is fixed. Adjacent the fixed panel 5, sliding panel 6 is provided with an alignment block, guide shoe, and floor guide, as discussed above. FIG. 6 shows a view of how the sliding panel 6 interfaces with a floor 92 using floor guide assembly 64 and guide shoe 60 of an embodiment of the invention with a concave guide shoe 60 and floor guide track 66. Here, the floor guide assembly 64 is mounted to the floor 92 directly (i.e. surface mounted). The floor guide assembly may be fastened to the floor using screws, nails, adhesives, or the like. This provides quick and easy installation of the system.

FIGS. 7 and 8 show embodiments implementing a raised floor guide. FIG. 7 shows sliding panel 6 provided with an pin guide assembly 29 and guide shoe 83 that slides along a floor guide 100. In this embodiment, the floor guide assembly 100 includes a floor guide track 84 and floor guide body 106 and connects to the floor 92 via the floor guide body 106. In this embodiment, the floor guide track 84 is modular and is snap-fit or otherwise releasably connected with guide body 106. More specifically, floor guide track 84 can snap into and out of floor guide body 106. Floor guide body 106 is mounted to the floor 92, for example, using screws, nails, adhesive or the like. This embodiment is advantageous for use in settings where the door may be installed over a carpet. The raised threshold ensures that sliding door 2 will not be impeded by fibers of the carpet, rug, runner, or the like. Additionally, the floor guide track 84 can be replaced with little to no damage to the floor 92.

FIG. 8. shows an embodiment of the invention similar to that of FIG. 7, except with a floor guide assembly 200 that includes a convex floor guide track 202 attached to floor 92 using floor guide body 202 and a concave guide shoe 60.

In the embodiments discussed above, with regard to FIGS. 7 and 8, the floor guide body 106, 202 may be formed by an aluminum extrusion. Additionally, floor guide track 84, 202 may be made from materials that will slide easily against the guide shoe. Suitable materials include plastics, metals, composite materials and the like with a lubricating and wear resistant coating applied to the surface in contact with the guide shoe. In a preferred embodiment, the floor guide track 84, 202 is made from plastic or Teflon coated aluminum. This allows for quieter operation of the sliding door 2 while also providing reduced manufacturing costs.

Figure 9:
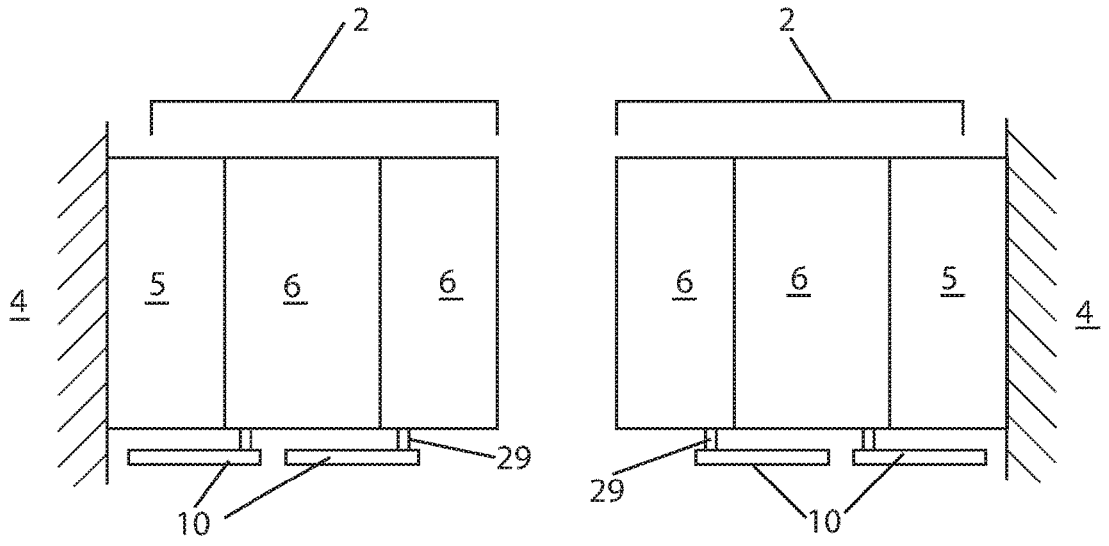
FIG. 9 is a front view of an automatic sliding door including a plurality of panels with associated floor assembly guides in accordance with yet another embodiment of the invention.

FIG. 9 shows an embodiment of the invention where an automatic sliding door 2 includes multiple panels 6 on each side of the doorway. Multiple panels 6 are used to accommodate a wide doorway. In this embodiment, each of the four panels 6 has an associated pin guide assembly 29 located near a bottom surface. Each pin guide assembly 29 is mated with a respective floor guide assembly 10, 100, 200 installed on the floor. The floor guide assembly 10, 100, 200 may be removeably connected to the floor as shown, for example, in FIGS. 7 and 8. In order to allow the sliding door 2 to open and close, each panel 6 is offset from the others so that they slide past one another and past fixed panels 5 on either side of the doorway.

Figure 10:
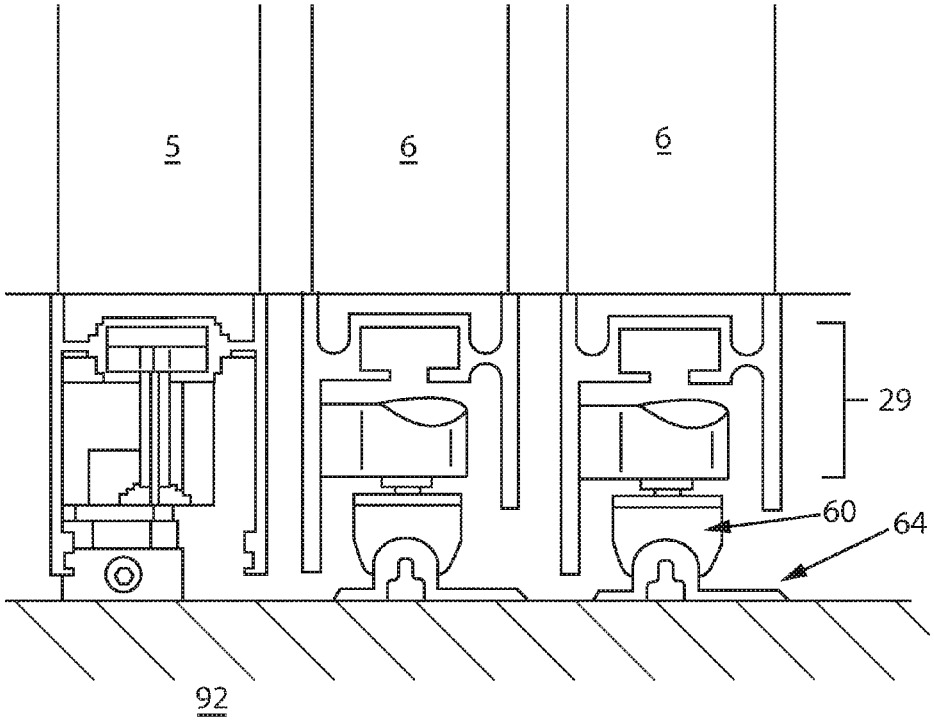
FIG. 10 is an end view showing a vertical cross section of the sliding door and floor guide assemblies of the embodiment of FIG. 9.

FIG. 10 shows a cross section of an automatic sliding door with associated floor guide assembly according to another embodiment the invention where multiple panels are used on each side of the door such as the one shown in FIG. 9. In this embodiment there are three panels, a fixed panel 5 and two sliding panels 6. pin guide assembly 29 are attached to panels 6. Each pin guide assembly 29 includes guide shoe 60 and has an associated floor guide assembly 64 attached to the floor 92 so that each panel 6 can slide along its own floor guide assembly 64. Each panel 6 is offset from the others so that the sliding door may open and close telescopically. Although this embodiment shows one stationary panel 5 and two sliding panels 6 any number of sliding panels 6 with associated pin guide assembly 29 and floor guide assemblies 64 may be implemented depending on the size of the door frame and the width of the doorway.

FIGS. 11A-12B show further embodiments of the invention including a lock-stop affixed to a portion of the guide track that limits the travel of the guide shoe along the floor guide assembly. According to one embodiment, the lock-stop is positioned on the end of the floor guide assembly and prevents the guide shoe from sliding past the end of the floor guide assembly. When the door is closed, the guide shoe is positioned against the lock-stop and the lock-stop prevents the guide shoe from disengaging from the floor guide assembly.

Figure 11A:
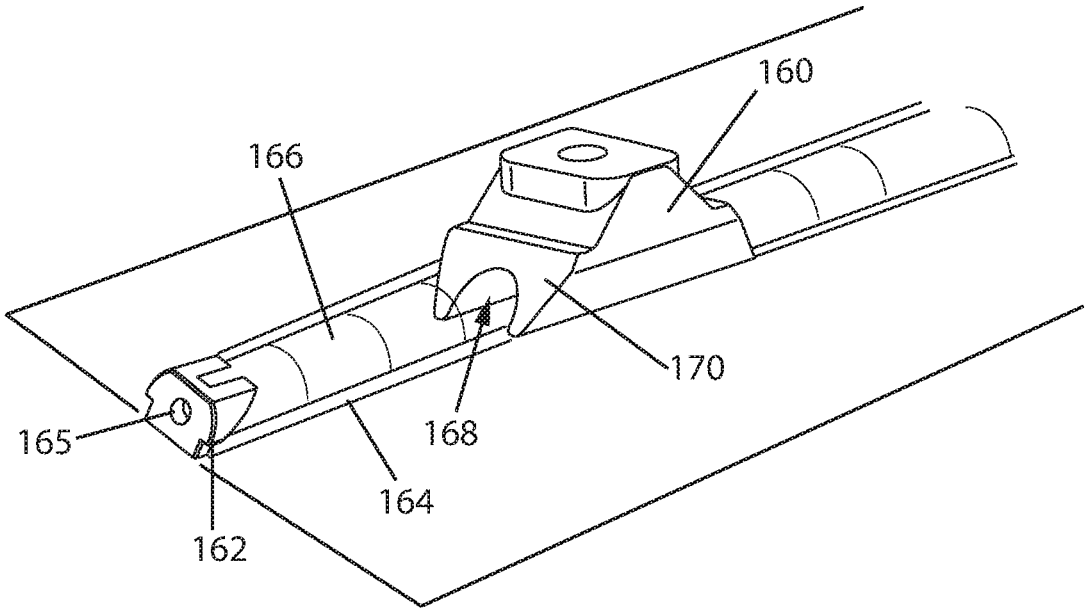
FIG. 11A is a side perspective view of a floor guide assembly including a lock-stop according to an embodiment of the invention.
Figure 11B:
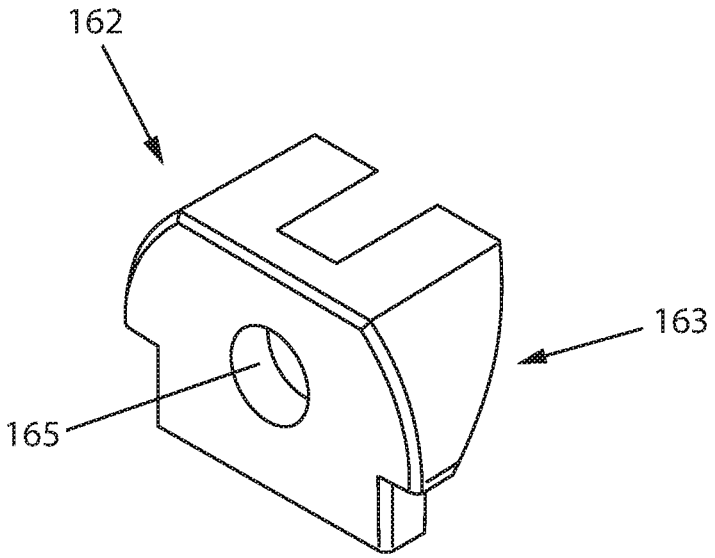
FIG. 11B is a perspective view of the lock-stop according to the embodiment of FIG. 11A.

FIG. 11A shows a lock-stop 162 attached to the floor guide assembly 164. Here the floor guide assembly includes a floor guide track 166 that has a convex upper surface, such as the one shown in FIG. 4A. Lock-stop 162 is attached to an end of the track 166 using screws, nails, adhesives, or the like. In the embodiment shown in FIG. 11A, the lock-stop includes a thru hole 165. A bolt or screw extends through the thru hole 165 and into the end of the track 166. As shown in FIG. 11B, the lock-stop includes an engagement surface 163 that is beveled. When the lock-stop 162 is connected with the end of the track 166, the engagement surface 163 faces toward the guide shoe 160. When the door is moved into the closed position, the guide shoe 160 contacts the lock-stop 162. The surface 163 of the lock-stop 162 interface with the beveled surface 170 of shoe guide 160. Because the beveled surface of the lock-stop 162 is above the beveled surface 170 of the guide shoe, the guide shoe 160 is prevented from moving vertically and thus, cannot disengage from the track 166. This arrangement allows the door to be securely locked.

Figure 12A:
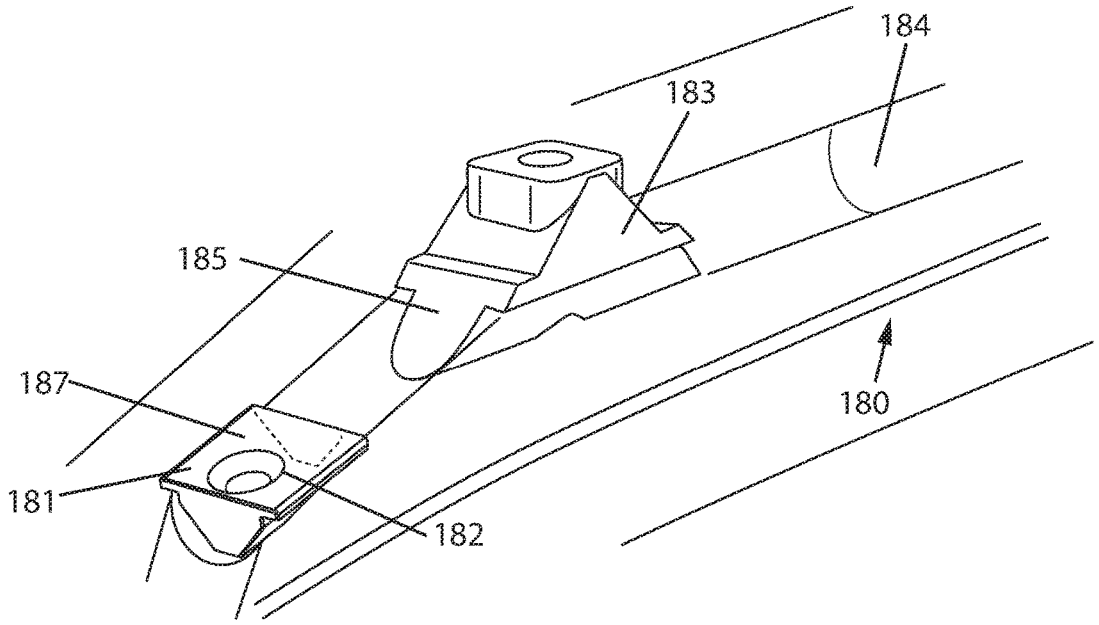
FIG. 12A is a side perspective view of a floor guide assembly including a lock-stop according to another the embodiment of the invention.
Figure 12B:
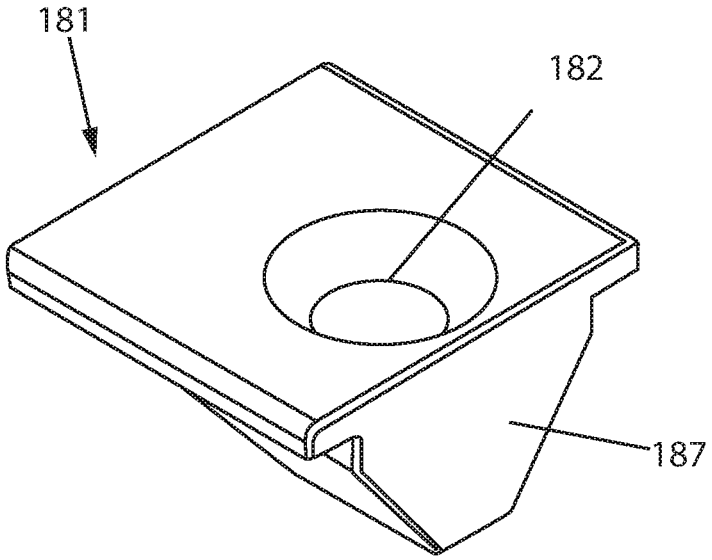
FIG. 12B is an perspective view of the lock-stop according to the embodiment of FIG. 12A.
Figure 12C:
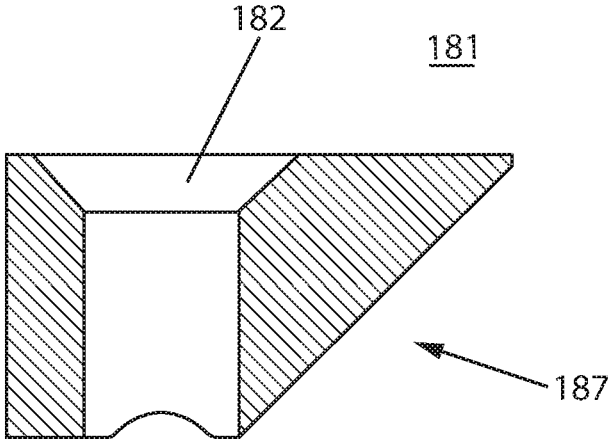
FIG. 12C is a cross section of the lock-stop according to the embodiment of FIG. 12A.

FIG. 12A shows an alternate embodiment of the invention including a lock-stop 181 that interfaces with the guide shoe 183 where the guide track 184 has a concave upper surface, such as the one shown in FIG. 5A. According to this embodiment, the lock-stop 181 is positioned within the concave track 184. Lock-stop 181 includes a thru hole 182 and is fastened to the floor guide assembly 180 using a screw or bolt extending through the thru hole 182 and into the floor guide assembly 180. As shown in FIG. 12C, the lock-stop 181 includes an engagement surface 187. When the door is positioned so that the guide shoe 183 contacts the lock-stop 181, the engagement surface 187 of the lock-stop 181 interfaces with the beveled surface 185 of guide shoe 183. This engagement prevents the guide shoe from disengaging from the track 184 and allows the door to be securely locked.

According to the embodiments shown in FIGS. 11A-12B, and as previously discussed, when the door 2 is in a fully closed position the beveled surface 170, 180 of the guide shoe 160, 183 interfaces with the engagement surface 163, 187 of the lock-stop 162, 181, preventing the guide shoe 160, 183 from moving beyond the end of the track. In situations where the door is allowed to swing, for example, when it has been forced open during an emergency evacuation, the weight of the door shifts because the door hangs from its top heal corner. This weight shift may cause the door to tilt, forcing the guide shoe 160, 183 toward the end of the track. If the guide shoe were to fall off the end of the track, this could require an expensive service call. The engagement of the guide shoe 160, 183 and the lock-stop 162, 181 prevents the guide shoe falling off the end of the track.

Although some embodiments are described with respect to automatic sliding doors, the invention is not so limited, and the methods and systems described herein may be applied in conjunction with other types of doors, including manually operated doors.

It will be appreciated by those skilled in the field of the invention that various modifications and changes can be made to the invention without departing from the spirit and scope of this invention. Accordingly, all such modifications and changes fall within the scope of the appended claims and are intended to be part of this invention.

I claim:

1. A sliding door comprising:
a door panel;
a floor guide;
a pin guide assembly connected with a bottom of the door panel;
a guide shoe connected with the pin guide assembly; and
a lock-stop connected with the floor guide;
wherein the guide shoe includes a concave mating surface, wherein the floor guide includes a rail having a convex mating surface shaped to correspond with the mating surface of the guide shoe, wherein the mating surfaces of the guide shoe and floor guide are in sliding contact with one another, wherein the guide shoe further comprises two beveled surfaces on opposing terminal ends of the guide shoe arranged along a direction of travel of the guide shoe along the rail; and wherein at least one of the beveled surfaces of the guide shoe engages with an engagement surface of the lock-stop to prevent the guide shoe from disengaging from the floor guide, such that when the at least one beveled surface is engaged with the engagement surface at least a portion of the beveled surface is between the engagement surface and the floor guide.

2. The sliding door of claim 1, wherein the mating surface of the guide shoe forms a portion of a cylinder.

3. The sliding door of claim 2, wherein the portion of the cylinder has a diameter less than about 1 inch.

4. The sliding door of claim 2, wherein the portion of the cylinder has a diameter between about 0.25 and 0.75 inches.

5. The sliding door of claim 2, wherein the portion of the cylinder has a diameter of about 0.315 inches.

6. The sliding door of claim 1, further comprising:
a plurality of door panels wherein each door panel has an associated floor guide, pin guide assembly, and guide shoe.

7. The sliding door of claim 1, wherein the pin guide assembly includes an extendable shaft connected with the guide shoe and further comprises a mechanism that applies force to the guide shoe to press the mating surface of the guide shoe against the mating surface of the floor guide.

8. The sliding door of claim 7, wherein the pin guide assembly further comprises a housing including a slot, wherein the extendable shaft includes a set screw that fits within the slot, wherein the set screw is fixed to the shaft and slidable along the slot, and wherein engagement of the set screw and the ends of the slot limit the motion of the extendable shaft.

9. The sliding door of claim 1, wherein the beveled surface joins the concave mating surface at an acute angle at the terminal end.

10. A sliding door comprising:
a door panel;
a floor guide;
a pin guide assembly connected with a bottom of the door panel;
a guide shoe connected with the pin guide assembly; and
a lock-stop connected with the floor guide;
wherein the guide shoe includes a convex mating surface, wherein the floor guide includes a rail having a concave mating surface shaped to correspond with the mating surface of the guide shoe, wherein the mating surfaces of the guide shoe and floor guide are in sliding contact with one another, wherein the guide shoe further comprises two beveled surfaces on opposing terminal ends of the guide shoe arranged along a direction of travel of the guide shoe along the rail; and wherein at least one of the beveled surfaces of the guide shoe engages with an engagement surface of the lock-stop to prevent the guide shoe from disengaging from the floor guide, such that when the at least one beveled surface is engaged with the engagement surface at least a portion of the beveled surface is between the engagement surface and the floor guide.

11. The sliding door of claim 10, wherein the mating surface of the guide shoe forms a portion of a cylinder.

12. The sliding door of claim 11, wherein the portion of the cylinder has a diameter less than about 1 inch.

13. The sliding door of claim 11, wherein the portion of the cylinder has a diameter between about 0.25 and 0.75 inches.

14. The sliding door of claim 11, wherein the portion of the cylinder has a diameter of about 0.315 inches.

15. The sliding door of claim 10, further comprising:
a plurality of door panels wherein each door panel has an associated floor guide, pin guide assembly, and guide shoe.

16. The sliding door of claim 10, wherein the pin guide assembly includes an extendable shaft connected with the guide shoe and further comprises a mechanism that applies force to the guide shoe to press the mating surface of the guide shoe against the mating surface of the floor guide.

17. The sliding door of claim 16, wherein the pin guide assembly further comprises a housing including a slot, wherein the extendable shaft includes a set screw on the extendable shaft that fits within the slot, wherein the set screw is fixed to the shaft and slidable along the slot, and wherein engagement of the set screw with the ends of the slot limit the motion of the extendable shaft.

18. The sliding door of claim 10, wherein the beveled surface joins the convex mating surface at an acute angle at the terminal end.

* * * * *